United States Patent [19]

Villavicencio

[11] Patent Number: 4,857,145

[45] **Date of Patent: * Aug. 15, 1989**

[54] PROCESS FOR MAKING A PULP FROM BAMBOO

[75] Inventor: Eduardo J. Villavicencio, San Angel, Mexico

[73] Assignee: Process Evaluation and Development Corporation, Dallas, Tex.

[ * ] Notice: The portion of the term of this patent subsequent to Aug. 25, 2004 has been disclaimed.

[21] Appl. No.: 72,320

[22] Filed: Jul. 13, 1987

[51] Int. Cl.[4] ..... D21C 3/26

[52] U.S. Cl. ..... 162/19; 162/22; 162/24; 162/52; 162/65; 162/94; 162/96; 162/90; 162/83; 162/241; 162/246

[58] Field of Search ..... 162/94, 24, 19, 17, 162/25, 26, 21, 22, 90, 241, 246, 18, 28, 52, 96, 83, 65

[56] References Cited

U.S. PATENT DOCUMENTS

| | | | |
|---|---|---|---|
| 87,433 | 3/1869 | Robbins et al. | 162/94 X |
| 1,717,794 | 6/1929 | Marr | 162/94 X |
| 4,260,452 | 4/1981 | Krüger et al. | 162/24 X |
| 4,689,117 | 8/1987 | Villavicencio | 162/94 X |

FOREIGN PATENT DOCUMENTS

| | | | |
|---|---|---|---|
| 265697 | 2/1927 | United Kingdom | 162/94 |

*Primary Examiner*—David L. Lacey
*Assistant Examiner*—Thi Dang
*Attorney, Agent, or Firm*—Fisher, Christen & Sabol

[57] ABSTRACT

Bamboo can be formed into a suitable pulp if prior to digestion it undergoes a process of shredding, washing and wet depithing. The fibers are then chemically digested preferably by a process which uses rapid pressure drops to open the fibers using the energy contained in the wet superheated fibers.

9 Claims, 1 Drawing Sheet

PROCESS FOR MAKING A PULP FROM BAMBOO

BACKGROUND OF THE INVENTION

This invention relates to a method for preparing bamboo to produce a bamboo pulp suitable for producing high strength paper products. More particularly, this invention relates to a method of preparing bamboo for digestion at an elevated temperature and pressure by shredding, washing and wet depithing.

DESCRIPTION OF THE INVENTION

Bamboo is present in the world in many varieties. One prevalent variety, and one which contains relatively long fibers, is Bambusa Vulgaris. A typical bamboo of this variety contains about 10 percent pith and about 8 percent nodes and silica. The nodes are the barriers that divide the bamboo into linear segments. The true fiber content is about 60 percent with vessel segments comprising about 22 percent. Vessel segments are the conduits or tubes that transport the liquid nutrients. The paper making value of vessel segments is low. The true fiber content is the high quality fiber portion that forms the pulp after digestion.

The chemical composition of Bambusa Vulgaris does not differ that must from typical pine wood fiber sources. The following Table 1 provides typical analytical data for Bambusa Vulgaris and for three varieties of pine wood.

TABLE 1

| | | Pine Wood Fibers | | |
|---|---|---|---|---|
| Component | *B. Vulgaris* | Saligna | Elliotti | Augustifol |
| Cellulose | 49.2 | 54.6 | 55.5 | 58.3 |
| Lignin | 14.5 | 25.5 | 26.6 | 28.5 |
| Pentosans | 22.3 | 16.4 | 7.1 | 6.1 |
| Solubles: | | | | |
| NaOH 1% | 33.4 | 14.8 | 16.9 | 10.6 |
| Hot Water | 15.0 | 1.6 | 3.8 | 2.5 |
| Alcohol/ Benzene | 5.2 | 1.4 | 6.7 | 0.9 |
| Ash | 1.8 | 0.3 | 0.3 | 0.3 |

In addition, the length of usable fibers of Bambusa Vulgaris is similar to that of the typical pine sources. However, one signifricant difference is the higher wax and phenolic content of bomboos which necessitates different processing and digestion than is suitable for pine woods. This wax content protects the bamboo from moisture and insects as it grows and must be removed to produce a good pulp.

A tpyical method for preparing bamboo for digestion is to chip the bamboo. This is a techinque used extensively for producing pulps from pine woods. A chipper is a piece of machiner with a series of knives which cut chips of the bamboo from the larger stalks. The chips are of a size of about 0.32 cm. thick, about 1.9 cm. in length and in width. In contrast to a chipper, a shredder produces elongated fragments. While a shreadded would be useful for wood, it is very useful for bamboo. Bamboo is essentially a series of hollow segments having a wall thickness of about 1 to 3 centimeters. Shredded bamboo consists of elongated fragments of from 10 to 25 centimeters or more in length. The result is that there are most longer fibers present after shredding than after shipping. Chipping cuts many fibers and thus results in a greater number of shorter fibers in the final pulp. Shredding does not cut the fibers. The fibers are not damaged at the first stage of processing. In addition, shredding produces a fiber that can be further processed prior to digestion. A chipped bamboo in many prior art processes is then flowed directly to impregnation and/or digestion after chipping. However, in the prior process of the present inventor, the chipped bamboo was then shredded and depithed. In contrast in the new process, the bamboo is solely shredded and then is passed to a washer such as the Peadco Washer described in U.S. Pat. No. 3,992,745 and then wet depithed using a depither such as the Peadco Depither described in U.S. Pat. No. 3,688,345. The result is a long input fiber with less fiber damage to digestion which has a substantial amount of the non-fibrous material removed and which can be digested at a faster rate. Digestion proceeds at a faster rate since the depithed fibers are quickly impregnated with the black liquor and digestion chemical solutions.

This particular pre-digestion processing for bamboo is preferably used in combination with a digestion process which consists of a sequence of treatment with black liquor or digestion chemicals at a super atmospheric pressure for a first period of time, the addition of further digestion chemicals followed by a rapid reduction in pressure of at least about 0.5 kg/cm$^2$, and a treatment at this lower, but super-atmospheric, pressure for a second period of time. This sequence of digestion chemical addition followed by a rapid pressure reduction can be repeated a number of times. Each rapid pressure reduction opens the fiber bundles by the conversion of included water to steam and also causes the concentration of the added digestion chemicals on the fibers. When this digestion sequence is used in combination with the above described pre-processing sequence a pulp is obtained which is very similar to that of a wood long fiber source.

SUMMARY OF THE INVENTION

In brief summary, this invention relates to the preparation of bamboo for digestion by shredding the bamboo, washing the shredded bamboo to remove solubles, dirt and other occluded material, and wet depithing the washed and shredded bamboo. The bamboo is then digested at an elevated temperature and pressure using black liquor and optionally digestion chemicals in the first digestion step, and digestion chemicals in subsequent steps. Between each digestion step there is a rpaid reduction of the pressure on the bamboo fibers. Also, each addition of digestion chemicals in the subsequent digestion steps is just prior to the rapid pressure reduction. This provides for better fiber opening and a concentration of the added chemicals on the newly exposed fiber surfaces.

BRIEF DESCRIPTION OF THE DRAWING

The FIG. 1 is a schematic of the preferred method of practicing the present process.

DETAILED DESCRIPTION OF THE INVENTION

Figure 1:
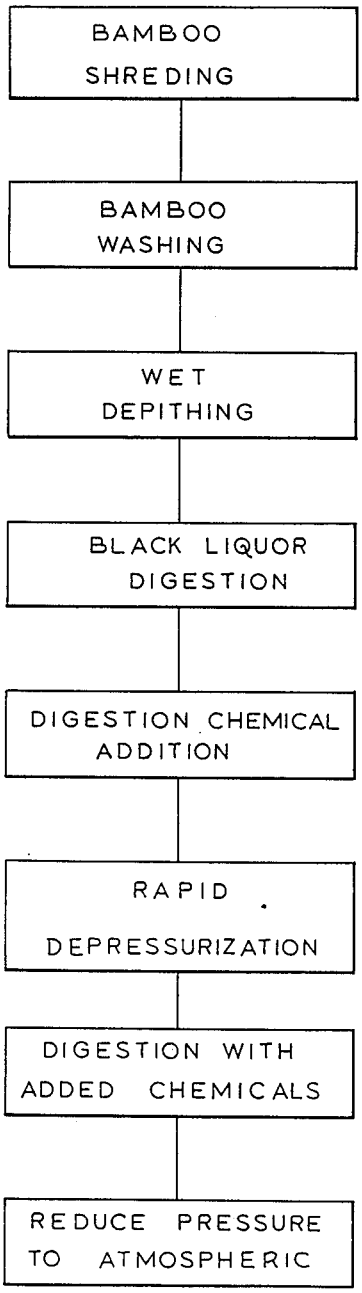

The quality of bamboo pulp is directly related to the extent of the removal of parenchyma cells and nodes. The parenchyma cells which are spongy and have a high liquid absorption potential. They keep the plant liquid nutrients "in storage" until they are consumed by the plant. The nodes are the segments which divide the bamboo stalk into sections. Water and various nutrients pass up the bamboo stalk. The nodes permit the passage of water and these nutrients, but removes silica, various minerals and other inorganics. It is the present objective to remove the parenchyma cells and the nodes at an early part of the processing. This then leaves primarily the fine structure of the bamboo fiber for processing. This is very similar to that of soft woods with one primary wall and three distinct secondary wall layers.

Most processes for making a bamboo pulp are batch processes. Batch processes and continuous processes give about the same results if the bamboo is not properly prepared. Most efforst thusfar to improve bamboo pulp has centered on the digestion stage. Batch processes have been converted to continuous processes. Processing times, temperatures and pressures have been changed again and again. The digestion chemicals and their ratios have been changed. However, there are not signficant advances unless the fiber is properly prepared prior to digestion. The present process will now be more particularly described with reference to the Figure.

In accordance with the Figure, the bamboo fiber should first be shredded. Bamboo is fed directly to a shredder such as the horizontal, multihammer shredder. This device consists of a heavy rotor, hammers, bed plate and a grill or bar screen. Bamboo of a smaller diameter, such as that less than 1 inch diamber, can first be fed to a cutter which will produce a product of maximum 2 inches long, the cuttings can be opened by a smaller shredder. In this way a smaller and less costly shredding device can be used.

The shredded bamboo which is in long segements of about 10 to 25 centimeters or more is then fed to a washer to remove solubles as well as rock, sand and other foreign material. Although many types of washers can be used it is preferred to use a washer which continuously submerges and works the shredded bamboo. A very useful washer is that described in U.S. Pat. No. 3,992,745, an improvement of which is described in U.S. Pat. No. 4,635,322. This is a U-shaped washer with the fiber input into one leg of the U and exiting the other leg of the U. Each leg of the washer contains rollers with tines which continuously submerge and work the fibers. At the loop of the U there is a deepened area where rock, dirt and other materials can be removed from the washer. The fibers are drained at the exit leg of the washer and fall from the washer into a pin feeder which feeds the shredded bamboo into the wet depither. Fresh water is continuously added to the washer to make-up for water losses.

The wet depither is preferably of a type as described in U.S. Pat. No. 3,688,345, an improvement of which is described in U.S. Pat. No. 4,641,792. This depither consists of a central rotor surrounded by a perforated basket. The rotor contains a series of knives which are arranged in a pattern to produce a downward spiral motion to the input fiber. The ends of the knives work the fibers against the perforated wall of the basket. Simultaneously water is injected into the depither. The combination of the action of the knives and the centrifugal force of water and air being propelled toward the basket by the rotating rotor reduces the size of the fiber bundles and forces the parenchyma, nodes, sand and short fibers through the basket wall. The water also removes various soluble components from the fibers. A fiber about 3 to 5 centimeters in length exits the depither. This existing fiber has a water content of about 78 percent to 85 percent. This fiber is then ready for input into a digester, and preferably a continuous digester. Water is added to the wet depither to maintain a continuous flow of water through the basket and to maintain the fiber at a water content of about 10 percent to 14 percent while the fiber is being worked in the depither.

A useful digestion process is one which contains multiple blow steps. By multiple blow is meant a process whereby the fiber undergoes a number of treatment steps at an elevated temperature and pressure. In between each step there is a rapid pressure reduction to a lower super atmospheric pressure. The rapid pressure reduction serves to open the fibers. Immediately prior to each rapid pressure reduction digestion chemicals are added if any are to be added to the process. The digestion chemicals that can be used are selected from the group consisting of sodium hydroxide, sodium sulfite, sodium bisulfite, sodium carbonate, oxygen, a bleach and mixtures thereof. The useful elevated operating temperature for the processing is in the range of bout 150° C. (centigrade) to 200° C. and preferably about 170° C. to 180° C. The pressure is the pressure of water (steam) at this temperature. In the rapid pressure reductions the pressure is reduced at least about 0.5 kg/cm$^2$. Although there is usually a black liquor impregnation and digestion step at the elevated temperature and pressure, an addition of digestion chemicals, a rapid pressure reduction, and a digestion with the added digestion chemicals followed by a blowdown to atmospheric pressure, additional steps of digestion chemical addition and rapid pressure reduction followed by digestion can be incorporated prior to the blowdown step. Further, the fiber can undergo a refining step prior to one or more of the rapid depressurization steps and prior to the blowdown to atmospheric pressure. Refining aids in breaking down the fiber bundles. The resulting pulp is then prepared like any other pulp for papermaking. These inlcude steps of washing, screening and centrifuging and optionally bleaching. The steps that would be used would depend on the paper products to be produced.

The following examples further describe the present invention.

EXAMPLE 1

This example describes the processing of a bamboo according to the present preparation method to produce bamboo pulp.

A long stalk Bamboo Vulgais (about 10 meters) was shredded using a horizontal multi-hammer shredder. The bamboo was shredded at the rate of 8 tons per hour. The shredded bamboo was flowed to a pin feeder and into a Peadco Washer. The residence time in the Peadco Washer is about 1 minute. From the exit of the Peadco Washer the washed bamboo fiber falls into the Peadco Wet Depither. The fiber exits the Peadco Wet Depither and is fed by means of a screw feeder to a tubular digester. The tubular digester has an inner diamger of 45 inches and a length of 30 feet. The fibers are moved through the tubular digester by a screw rotating at the rate of 1 RPM.

Along with the fiber black liquor and steam at 180° C. are added to the tubular digester. The black liquor is added to give a water/fiber ratio of 2.15:1. The black liquor has the following composition:

| | |
|---|---|
| sodium hydroxide | 0.2% |

-continued

| | |
|---|---|
| sodium carbonates | 6-7% |
| lignin | 5-8% |
| silica | 1.5% |

After about 12.5 minutes in the first digester the fiber is removed and a 10 percent by weight sodium hydroxide solution is added to give a sodium hydroxide/fiber ratio of 12.5%. This fiber is then defibered in a refiner and the pressure rapidly reduced by 1.0 kg/cm$^2$. Subsequently, the fiber flows into a second tubular digester of the same size as the first digester. The residence time of the fiber in this digester is 22.5 minutes whereafter the fiber is refined and the pressure reduced to atmospheric pressure. This fiber is then washed and centrifuged. The fiber yield is 55% and the K number 29/30. This pulp is suitable for making a kraft paper.

EXAMPLE 2

The procedure of Example 1 is repeated except that the ratio of sodium hydroxide to fiber is 15%. The yield is 50% and the K $MnO_4$ is 16/18. The G.E. Brightness is 40. This pulp is bleached using a three stage sequence. The final G.E. brightness is 84/86. This pulp is used to make writing paper.

EXAMPLE 3

This example describes the processing of a bamboo by a conventional chipping method to produce a bamboo pulp.

A long stalk bamboo was chipped into pieces of about 1.9 cm in length and width and about 0.32 cm thick. these chips were placed in a vertical digester and heated at 170° C. for 4 hours and 15 minutes. The water to fiber ratio was 4 to 1 and the sodium hydroxide to fiber percen5tage was 21%. After digestion, the fibers are blown down to atmospheric pressure. The properties of this pulp are set out in Table II in Example 4.

EXAMPLE 4

This example sets out a comparison of the properties of the bamboo pulp of Example 1 and Example 3 and a further comparison with the properties of a conventional wood pulp. The following Table II gives the comparison of these properties.

TABLE II

| PROPERTY | EXAMPLE 1 | EXAMPLE 3 | WOOD PULP |
|---|---|---|---|
| Initial Freeness ml. C.S.F. | 720 | 700 | 730 |
| Properties Freeness ml. C.S.F. | 450 | 450 | 450 |
| Tear Factor = R | 221 | 150 | 126 |
| Burst Factor | 62 | 48 | 82 |
| Tensile km. = T | 8.1 | 7.0 | 9.6 |
| Index TXR | 1790 | 1050 | 1209 |

The wood pulp is a conventional long fiber wood pulp from a soft wood source. This Table shows the bamboo pulp which had undergone the new processing according to this application has superior properties to a bamboo that had been chipped and is similar in many respect to a wood pulp.

I claim:

1. A method for producing a bamboo pulp suitable for producing high strength products comprising:

(a) shredding bamboo stalks to produce shredded bamboo fibers;

(b) water washing the shredded bamboo fibers to at least partially remove any soluble and non-soluble contaminants therefrom and to wet the shredded fibers;

(c) depithing said wet fibers with the addition of further amounts of water to remove more soluble contaminants;

(d) flowing said wet depithed fibers to a first chamber of a continuous digester;

(e) adding steam and a black liquor solution to said first chamber;

(f) partially digesting said fibers in said first chamber at a super-atmsopehric pressure for a first period of time to impregnate said fibers with water and black liquor;

(g) removing the partially digested fibers from said first chamber and adding a chemical digestion solution thereto;

(h) rapidly reducing the pressure on said partially digested fibers by at least 0.5 kg/cm but not below atmospheric pressure and flowing said partially digested fibers to a second chamber of the continuous digester;

(i) further digesting said partially digested fibers in said second chamber for a second period of times;

(j) removing the digested fibers from said second chamber and rapidly reducing the pressure thereon to atmospheric pressure; and (k) washing and screening said digested fibers from said second chamber to remove any undersized and oversized pieces and any soluble components therefrom.

2. A method for producing a bamboo pulp suitable for producing high strength products as in claim 1 wherein the moisture content of the fibers undergoing impregnation in said first chamber is at least 60 percent by weight.

3. A method for producing a bamboo pulp suitable for producing high strength products as in claim 2 wherein the retnetion time of said fibers in said first chamber is about 50 to 70 percent of the retention time of said fibers in said second chamber.

4. A method for producing a bamboo pulp suitable for producing high strength products as in claim 3 wherein the combined retention time of said fibers in said first chamber and said second chamber is about 30 to 60 minutes.

5. A method for producing a bamboo pulp suitable for producing high strength products as in claim 1 wherein said first chamber is maintained at a temperature of at least about 175° C. and at a pressure of at least about 8 kg/cm$^2$ gage and said second chamber is maintained at a temperature of at least about 170° C. and at a pressure of at least about 7 kg/cm$^2$ gage.

6. A method for producing a bamboo pulp suitable for producing high strength products as in claim 5 wherein said chemical digestion solution consists of a caustic solution containing sodium hydroxide in a concentration of at least about 100 grams per liter.

7. A method for producing a bamboo pulp suitable for producing high strength paper products comprising preparing bamboo by shredding said bamboo to produce elongated fiber pieces of about 10 centimeters and greater, washing the shredded bamboo, depithing the washed and shredded bamboo with the addition of water during depithing to produce depithed bamboo fibers, and digesting the depithed bamboo fibers by digesting the bamboo fibers in digestion chemicals in a first chamber at a super-atmospheric pressure for a first period of time, removing said bamboo fibers from said first chamber and adding more digestion chemicals thereto, rapidly reducing the pressure on said bamboo fibers by at least 0.5 kg/cm, but not below atmospheric pressure, and further digesting said bamboo fibers in a second chamber for a second period of time, and removing said bamboo fibers from said second chamber and thereafter reducing the pressure thereon to atmospheric pressure.

8. A method for producing a bamboo pulp suitable for producing high strencth products as in claim 2 wherein said digestion chemicals have a pH of about 8 to 14.

9. A method for producing a bamboo pulp suitable for producing high strength products as in claim 8 wherein said digestion chemicals are selected from the group consisting of sodium hydroxide, sodium sulfite, sodium bisulfite, sodium carbonate, oxygen, a bleach and mixtures thereof.

* * * * *